US008588444B2

(12) United States Patent
Pape et al.

(10) Patent No.: US 8,588,444 B2
(45) Date of Patent: Nov. 19, 2013

(54) METHOD AND HEARING DEVICE FOR FEEDBACK RECOGNITION AND SUPPRESSION WITH A DIRECTIONAL MICROPHONE

(75) Inventors: Sebastian Pape, Erlangen (DE); Stefan Petrausch, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 299 days.

(21) Appl. No.: 12/975,436

(22) Filed: Dec. 22, 2010

(65) Prior Publication Data

US 2011/0150250 A1 Jun. 23, 2011

(30) Foreign Application Priority Data

Dec. 22, 2009 (DE) ..... 10 2009 060 094

(51) Int. Cl.
*H04R 25/00* (2006.01)

(52) U.S. Cl.
USPC ..... 381/318; 381/312; 381/313; 381/320; 381/321

(58) Field of Classification Search
USPC ..... 381/313, 318, 312, 320, 213
See application file for complete search history.

(56) References Cited

U.S. PATENT DOCUMENTS

| | | | | |
|---|---|---|---|---|
| 6,072,884 | A | 6/2000 | Kates | |
| 6,104,822 | A | 8/2000 | Melanson et al. | |
| 6,275,596 | B1 * | 8/2001 | Fretz et al. | 381/321 |
| 6,751,325 | B1 | 6/2004 | Fischer | |
| 7,324,651 | B2 * | 1/2008 | Roeck | 381/318 |
| 7,688,990 | B2 * | 3/2010 | Hellgren et al. | 381/312 |
| 7,826,632 | B2 * | 11/2010 | Von Buol et al. | 381/313 |
| 8,189,833 | B2 * | 5/2012 | Klinkby et al. | 381/313 |
| 2008/0253596 | A1 | 10/2008 | Klinkby et al. | |
| 2008/0298615 | A1 * | 12/2008 | Klinkby et al. | 381/318 |
| 2009/0067651 | A1 * | 3/2009 | Klinkby et al. | 381/313 |
| 2010/0254555 | A1 | 10/2010 | Elmedyb et al. | |

FOREIGN PATENT DOCUMENTS

| | | | |
|---|---|---|---|
| EP | 1033063 | B1 | 5/2003 |
| EP | 1469702 | A2 | 10/2004 |
| EP | 2046073 | A1 | 4/2009 |
| WO | 0019770 | A1 | 4/2000 |
| WO | 2005091675 | A1 | 9/2005 |
| WO | 2007042025 | A1 | 4/2007 |
| WO | 2007113282 | A1 | 10/2007 |

* cited by examiner

*Primary Examiner* — Curtis Kuntz
*Assistant Examiner* — Ryan Robinson
(74) *Attorney, Agent, or Firm* — Laurence A. Greenberg; Werner H. Stemer; Ralph E. Locher

(57) ABSTRACT

A method operates a hearing device having at least two omnidirectional microphones emitting microphone signals and a detection unit for defining acoustic feedback. The method includes connecting a first electrical connection of the microphones to one another in order to form a first signal with directional effect, an adjustment of the directional effect of the first signal such that the acoustic feedback in the first signal is maximized, and an analysis of the first signal by the detection unit for defining the acoustic feedback. It is advantageous that the feedback can be detected by a signal with an improved signal-to-noise ratio. Feedbacks are therefore recognized more reliably and more rapidly.

11 Claims, 3 Drawing Sheets

METHOD AND HEARING DEVICE FOR FEEDBACK RECOGNITION AND SUPPRESSION WITH A DIRECTIONAL MICROPHONE

CROSS-REFERENCE TO RELATED APPLICATION

This application claims the priority, under 35 U.S.C. §119, of German application DE 10 2009 060 094.9, filed Dec. 22, 2009; the prior application is herewith incorporated by reference in its entirety.

BACKGROUND OF THE INVENTION

Field of the Invention

The invention relates to a method and a hearing device with improved feedback recognition and feedback suppression by the use of a directional microphone.

A frequent problem with hearing devices is the feedback between the output of the hearing device and the input, which becomes noticeable as an interfering whistling. FIG. 1 shows the principle of acoustic feedback. A hearing device 1 has a microphone 2, which receives an acoustic wanted signal 10, converts the signal into an electrical microphone signal 11 and outputs it to a signal processing unit 3. In the signal processing unit 3, the microphone signal 11 is inter alia prepared and amplified and output to a receiver 4 as an electrical receiver signal 12. In the receiver 4, the electrical receiver signal 12 is again converted into an acoustic output signal 13 and output to an eardrum 7 of a hearing device wearer.

The problem now consists in part of the acoustic output signal 13 reaching the input of the hearing device 1 by way of an acoustic feedback path 14, where it is superimposed with the wanted signal 10 and received by the microphone 2 as a sum signal. Therefore interfering feedback whistling results with an unfavorable phasing and amplitude of the fed-back output signal. In particular, with an open hearing device supply, the attenuation of the acoustic feedback is minimal, as a result of which the problem is intensified.

Adaptive systems for feedback suppression have been available as a solution for some time. To this end, the acoustic feedback path 14 in the hearing device 1 is digitally recreated. The recreation takes place for instance by an adaptive compensation filter 5, which is fed by the receiver signal 12. After a filtering in the compensation filter 5, a filtered compensation signal 15 is subtracted from the microphone signal 11. Ideally the effect of the acoustic feedback path 14 is cancelled and a feedback-free input signal 16 is produced for the signal processing unit 3.

A regulation and/or adaptation of filter coefficients of the adaptive compensation filter 5 is needed for effective feedback suppression. To this end, the microphone signal 11 is evaluated and checked for possible feedbacks with the aid of a detection unit 6. By regulating and/or adapting the filter coefficients, artifacts may however also develop, since additional signal components are generated or a feedback whistling occurs in the case of an adaptive compensation filter 5 which is not adjusted optimally. European patent EP 1 033 063 B1, corresponding to U.S. Pat. Nos. 6,104,822 and 6,072,884, discloses a hearing device with feedback suppression, with two adaptive compensation filters which operate in parallel being used in order to improve the feedback suppression.

The wanted signal 10 represents the greatest problem for optimal feedback suppression because it represents an interference signal from the perspective of a system for feedback suppression. What makes matters worse is that as a result of the amplification of the wanted signal 10 by the signal processing unit 3, the feedback signal 14 is highly correlated with the wanted signal 10, as a result of which the detection unit 6 is only able to make a distinction between feedback 14 and the wanted signal 10 with difficulty.

A correct adjustment of the adaptation speed of the compensation filter 5 is consequently of huge significance. If the adaptation is too slow, the feedback whistling occurs for some time until the suppression activates. If the adaptation is too quick, so-called "musical" artifacts (musical noise) occur, since the compensation filter 5 also attempts to compensate for the wanted signal. The detection unit 6 which always selects the optimal adaptation speed is therefore needed for feedback recognition. Therefore the behavior of the detection unit 6 is mainly responsible for a smooth function of the feedback suppression.

Directional microphone systems are among the interference noise suppression methods which have been established for years and these are subsequently shown to improve speech intelligibility in hearing situations in which the wanted signal and the noise signals are received from different directions. In modern hearing devices the directional effect is produced by differential processing of two or more adjacent microphones with omnidirectional characteristic.

FIG. 2 shows a simplified block diagram of a directional microphone system in the first arrangement with two microphones 21, 22 at a distance of around 10 to 15 mm. For sound signals arriving from the front V this causes an external delay of T2 between the first and the second microphone 21, 22, which corresponds for example to the distance from the microphones 21, 22 to one another. The signal R2 from the second microphone 22 is delayed by time T1 in a delay unit 23, inverted in the inverter 24 and added in the first adder 25 to the signal R1 from the first microphone 21. The sum yields the directional microphone signal RA that can be fed via a signal processing function to a receiver for example. The directional sensitivity essentially results from a subtraction of the second microphone signal R2, which was delayed by time T2, from the first signal R1. Thus after appropriate equalization, sound signals from the front V are not attenuated, whereas sound signals from the rear S, for example, are canceled out.

Adaptive directional microphones are microphones which are able to adjust to different ambient situations during current operation. Generally, the objective pursued here is the receiving and conveying of wanted sound output by a wanted sound source as effectively as possible, while the interfering sound originating from one or several interference sound sources is to be attenuated as effectively as possible in the output signal output by the adaptive directional microphone. International patent disclosure WO 00/19770 A1, corresponding to U.S. Pat. No. 6,751,325, discloses a hearing device with an adaptive directional microphone, with which the directional amplification/attenuation can be varied in accordance with the result of a signal analysis.

SUMMARY OF THE INVENTION

It is accordingly an object of the invention to provide a method and a hearing device for feedback recognition and suppression with a directional microphone which overcomes the above-mentioned disadvantages of the prior art devices and methods of this general type, which has improved feedback suppression.

The invention claims a method for the operation of a hearing device with at least two omnidirectional microphones emitting microphone signals and a detection unit for determining and/or recognizing and/or detecting an acoustic feedback. The microphones are electrically connected to one another with directional effect in order to form a first signal. The directional effect of the first signal is adjusted such that the acoustic feedback in the first signal is maximized and/or amplified to a maximum. The first signal is analyzed and/or evaluated by the detection unit in order to determine a possible acoustic feedback. The invention is advantageous in that the feedback can be detected by a signal with an improved signal-to-noise ratio. Feedbacks are thus recognized more reliably and rapidly.

In a development of the invention, the microphones can be connected to one another in order to form a second signal with directional effect. The directional effect of the second signal can be adjusted such that the acoustic feedback in the second signal is minimized, in other words, that only the wanted signal is contained as far as possible. The acoustic feedback in the second signal can be reduced by a second adaptive compensation filter, with it being controllable by the detection unit. It is advantageous in that feedback suppression can be executed more reliably and more rapidly.

In a further embodiment, a second signal can be formed from one of the microphone signals. The acoustic feedback in the second signal can be reduced by a second adaptive compensation filter, which can be controlled by the detection unit.

In a further embodiment, the acoustic feedback in the first signal can be reduced by a first adaptive compensation filter, which can be controlled by the detection unit. The acoustic feedback in the second signal can be reduced by a second adaptive compensation filter, which can be controlled by the first compensation filter. Filter parameters of the second compensation filter can be adjusted and/or "overwritten" as a "shadow filter" with the aid of a first compensation filter.

Furthermore, an acoustic output signal can be formed from the feedback-reduced second signal. This is presented to the eardrum of a hearing device wearer.

Furthermore, the method can be separately executed for several frequency bands.

The invention also specifies a hearing device with at least two omnidirectional microphones emitting microphone signals and a detection unit for defining an acoustic feedback. The hearing device also includes a first directional microphone unit for electrically connecting the microphones to one another in order to form a first signal with directional effect, with the directional effect of the first signal being adjusted such that the acoustic feedback in the first signal is maximized. The hearing device also includes a detection unit, which analyses the first signal for defining the acoustic feedback.

In a further embodiment, the hearing device includes a second directional microphone unit for electrically connecting the microphones to one another in order to form a second signal with directional effect, with the directional effect of the second signal being adjusted such that the acoustic feedback in the second signal is minimized. The hearing device also includes a second adaptive compensation filter for reducing the acoustic feedback in the second signal, with the second compensation filter being controllable by the detection unit.

In a development of the invention, the hearing device also includes a second adaptive compensation filter for reducing the acoustic feedback in a second signal formed by one of the microphone signals, with the second compensation filter being controllable by the detection unit.

Furthermore, the hearing device also includes a first adaptive compensation filter for reducing the acoustic feedback in the first signal, with the first compensation filter being controllable by the detection unit, and with the acoustic feedback in the second signal being reduced by the second adaptive compensation filter which can be controlled by the first compensation filter.

Furthermore, the hearing device can include a receiver, which forms an acoustic output signal from the feedback-reduced second signal.

Other features which are considered as characteristic for the invention are set forth in the appended claims.

Although the invention is illustrated and described herein as embodied in a method and a hearing device for feedback recognition and suppression with a directional microphone, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
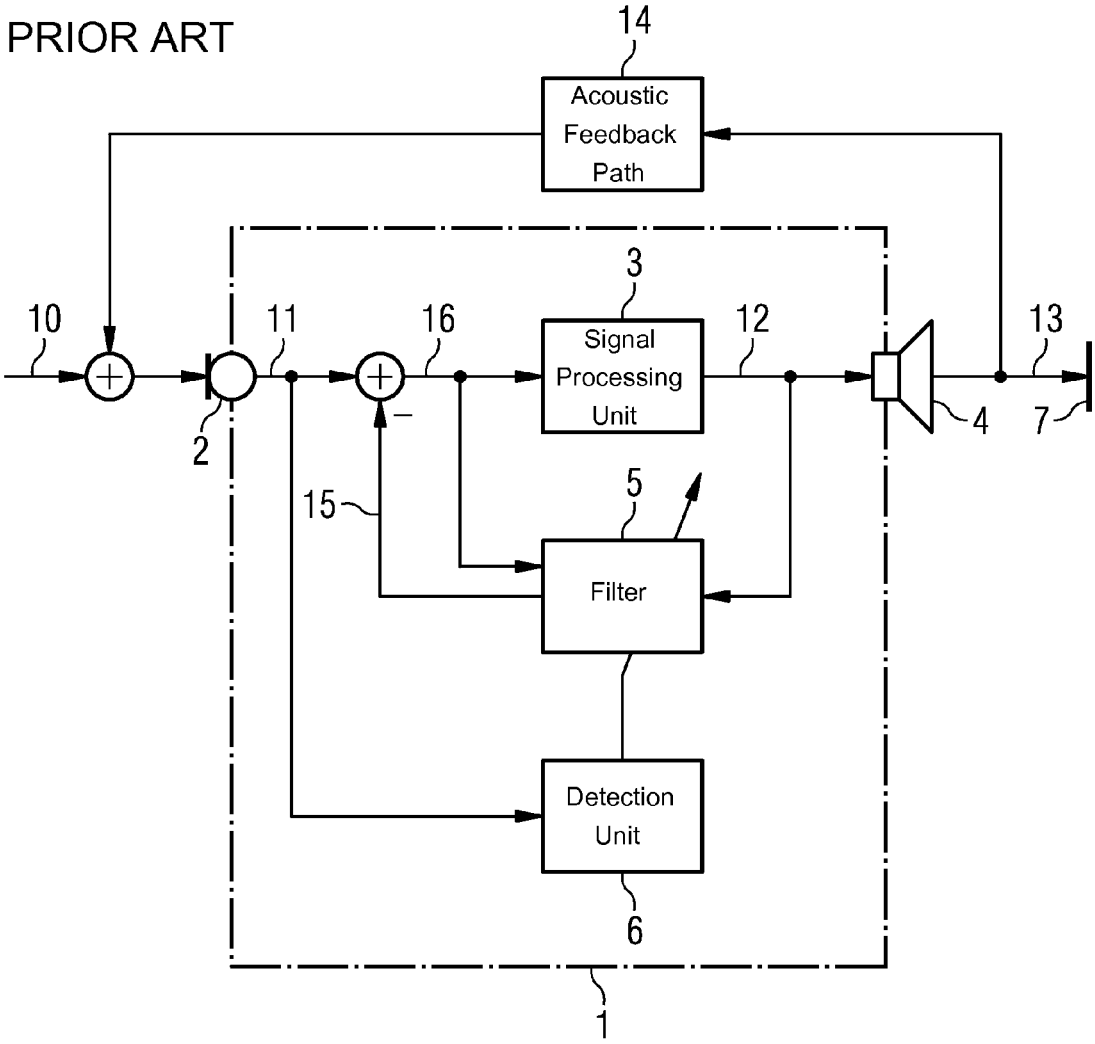
FIG 1 PRIOR ART
FIG. 1 is a block diagram of an adaptive feedback suppression according to the prior art.
Figure 2:
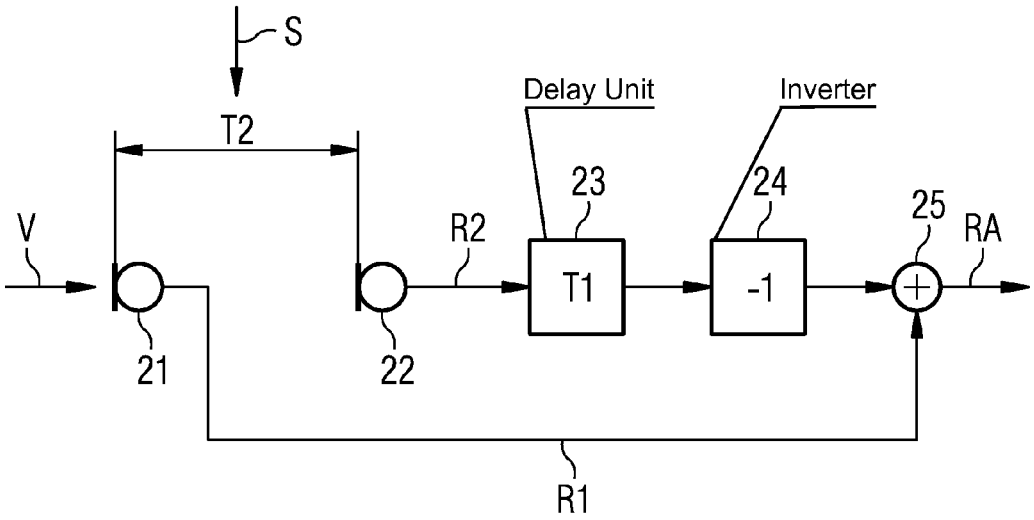
FIG 2 PRIOR ART
FIG. 2 is a block diagram of a directional microphone according to the prior art.
Figure 3:
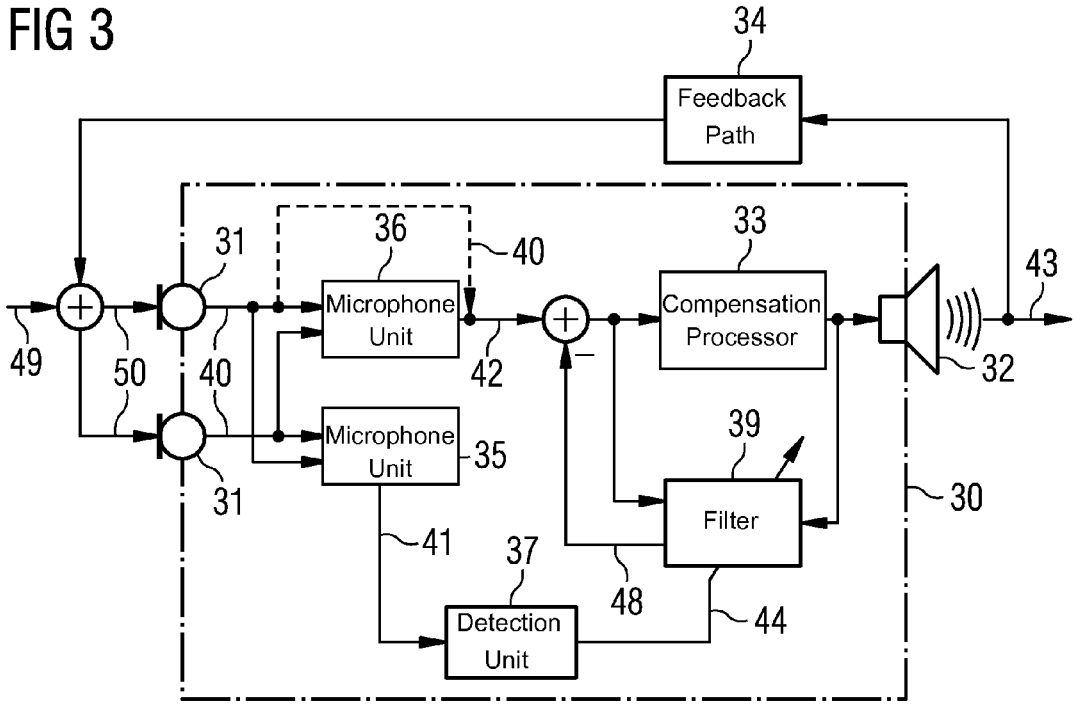
FIG. 3 is a block diagram of a hearing device with a directional microphone and an adaptive compensation filter according to the invention.

Referring now to the figures of the drawing in detail and first, particularly, to FIG. 3 thereof, there is shown a block diagram of a hearing device 30 having two microphones 31 for receiving an acoustic input signal 50 and a receiver 32 for emitting an acoustic output signal 43. A part of the acoustic output signal 43 is fed back to the microphones 31 by way of an acoustic feedback path 34, which may result in unwanted feedback whistling. The unwanted fed-back signal is superimposed with a desired wanted signal 49 to form the input signal 50.

To effectively suppress the possibly developing feedbacks, the feedback path 34 is recreated as precisely as possible with the aid of a second adaptive compensation filter 39. An output of the second compensation filter 39 supplies a compensation signal 48, which is subtracted from a second signal 42 at an input of a signal processor 33 of the hearing device 30. The second signal 42 can either be one of the microphone signals 40 of the microphone 31 (shown with a dashed line in FIG. 3), or it is a signal with directional effect which is formed from the two microphone signals 40 with the aid of a second adaptive directional microphone unit 36. The directional effect of the second signal 42 is adjusted such that the wanted signal 49 is as strong as possible and the feedback signal 34 is as weak as possible.

The second adaptive compensation filter 39 is controlled by a first control signal 44 of a detection unit 37. Therefore the filter parameters of the second compensation filter 39 can be changed by the detection unit 37. The object of the detection unit 37 is to effectively recognize feedbacks in the input signal 50. To this end, the two microphone signals 40 are electrically connected to one another in a first adaptive directional microphone unit 35, so that a first signal 41 is produced with directional effect. The directional microphone unit 35 is adjusted such that the acoustic feedback appears amplified to a maximum degree in the first signal 41. In other words, the directional microphone formed by the two microphones 31 "looks" in the direction of the feedback path 34. As a result, the signal-to-noise ratio of the first signal 41 is maximized. The first signal 41 is now fed to the detection unit 37, which can identify acoustic feedbacks in a known fashion.

Figure 4:
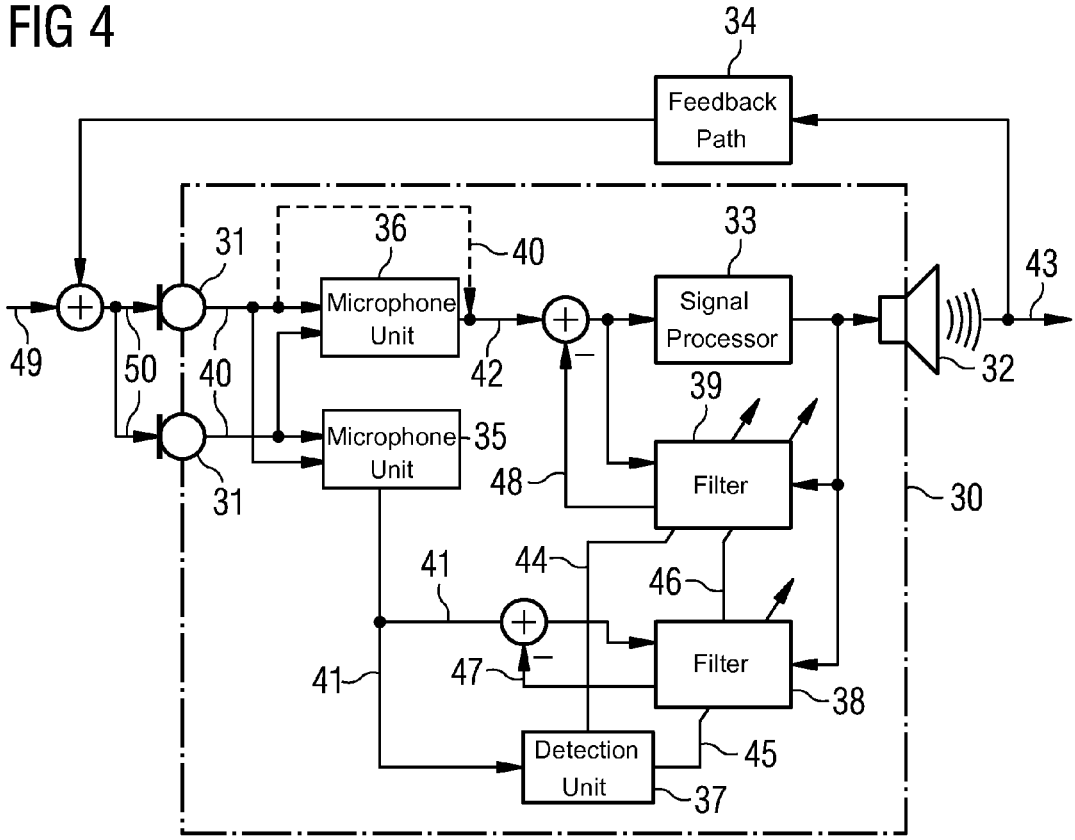
FIG. 4 is a block diagram of the hearing device with the directional microphone and an adaptive shadow compensation filter according to the invention.

FIG. 4 shows a block diagram of a hearing device 30 having two microphones 31 for receiving an acoustic input signal 50 and a receiver 32 for emitting an acoustic output signal 43. A part of the acoustic output signal 43 is fed back to the microphones 31 by way of an acoustic feedback path 34, which may result in unwanted feedback whistling. The unwanted feedback signal is superimposed with a desired wanted signal 49 to form the input signal 50.

To effectively suppress the possibly developing feedbacks, the feedback path 34 is recreated as precisely as possible with the aid of a second adaptive compensation filter 39. An output of the second compensation filter 39 supplies a compensation signal 48, which is subtracted from a second signal 42 at an input of a signal processing 33 of the hearing device 30. The second signal 42 can either be one of the microphone signals 40 of the microphone 31 (shown with a dashed line in FIG. 4), or it is a signal with directional effect which is formed from the two microphone signals 40 with the aid of a second adaptive directional microphone unit 36. The directional effect of the second signal 42 is adjusted such that the wanted signal 49 is as strong as possible and the feedback signal 34 is as weak as possible.

The second adaptive compensation filter 39 is controlled by a first control signal 44 of a detection unit 37. Therefore the filter parameters of the second compensation filter 39 can be changed by the detection unit 37. The object of the detection unit 37 is to effectively recognize feedbacks in the input signal 50. To this end, the two microphone signals 40 are electrically connected to one another in a first adaptive directional microphone unit 35, so that a first signal 41 is produced with directional effect. The directional microphone unit 35 is adjusted such that the acoustic feedback appears amplified to a maximum degree in the first signal 41. In other words, the directional microphone formed by the two microphones 31 "looks" in the direction of the feedback path 34. As a result, the signal-to-noise ratio of the first signal 41 is maximized. The first signal 41 is now fed to the detection unit 37, which can identify acoustic feedbacks in a known fashion.

In addition to the second adaptive compensation filter 39, the hearing device 30 also includes a first adaptive compensation filter 38 in accordance with the invention, which is arranged in the path between the output of the signal processing unit 33 and the first signal 41. This so-called "shadow filter" 38 is controlled by a second control signal 45 of the detection unit 37 such that a first compensation signal 47 of the first compensation filter 38 corresponds as precisely as possible to the fed-back signal. The first compensation signal 47 is subtracted from the first signal 41 and fed to an input of the first compensation filter 46. An output of the first compensation filter 46 supplies a third control signal 46, which is used to control and/or adjust the second compensation filter 39. The filter parameters of the second compensation filter can therefore be "overwritten" for instance with the aid of a first compensation filter 38.

With the inventive solution according to FIG. 4, the second compensation filter 39 is therefore controlled both by the detection unit 37 directly or also indirectly by way of the "shadow filter" 38.

The invention claimed is:

1. A method for operating a hearing device having at least two omnidirectional microphones emitting microphone signals and a detection unit for defining acoustic feedback, which comprises the steps of:

electrically connecting the omnidirectional microphones with one another to form a first signal with a directional effect;

adaptively adjusting the directional effect of the first signal such that acoustic feedback in the first signal is maximized; and analyzing the first signal via the detection unit to define the acoustic feedback.

2. The method according to claim 1, which further comprises:

electrically connecting the omnidirectional microphones with another to form a second signal with a directional effect;

adjusting the directional effect of the second signal such that acoustic feedback in the second signal is minimized; and reducing the acoustic feedback in the second signal via an adaptive compensation filter, which can be controlled by means of the detection unit.

3. The method according to claim 1, which further comprises:

forming a second signal from one of the microphone signals; and reducing acoustic feedback in the second signal via an adaptive compensation filter, which can be controlled by means of the detection unit.

4. The method according to claim 2, which further comprises:

reducing the acoustic feedback in the first signal via a further adaptive compensation filter, which can be controlled by means of the detection unit; and reducing the acoustic feedback in the second signal via the adaptive compensation filter, which can be controlled by the further adaptive compensation filter, resulting in a feedback-reduced second signal.

5. The method according to claim 4, which further comprises forming an acoustic output signal from the feedback-reduced second signal.

6. The method according to claim 1, which further comprises executing it separately for several frequency bands.

7. A hearing device, comprising:

at least two omnidirectional microphones emitting microphone signals;

a detection unit for defining acoustic feedback;

a first directional microphone unit for electrically connecting said omnidirectional microphones to one another to form a first signal with directional effect, with the directional effect of the first signal being adaptively adjusted such that acoustic feedback in the first signal is maximized; and said detection unit analyzing the first signal for defining the acoustic feedback.

8. The hearing device according to claim 7, further comprising:

a second directional microphone unit for electrically connecting said omnidirectional microphones to one another to form a second signal with directional effect, with the directional effect of the second signal being adjusted such that acoustic feedback in the second signal is minimized; and an adaptive compensation filter for reducing the acoustic feedback in the second signal, with said adaptive compensation filter being controllable by said detection unit.

9. The hearing device according to claim 8, wherein said adaptive compensation filter for reducing the acoustic feedback in the second signal formed by one of the microphone signals, with said adaptive compensation filter being controllable by said detection unit.

10. A hearing device, comprising:

at least two omnidirectional microphones emitting microphone signals;

a first directional microphone unit for electrically connecting said omnidirectional microphones to one another to form a first signal with directional effect, with the directional effect of the first signal being adaptively adjusted such that acoustic feedback in the first signal is maximized;

a detection unit for defining acoustic feedback, said detection unit analyzing the first signal for defining the acoustic feedback a second directional microphone unit for electrically connecting said omnidirectional microphones to one another to form a second signal with directional effect, with the directional effect of the second signal being adjusted such that acoustic feedback in the second signal is minimized;

an adaptive compensation filter for reducing the acoustic feedback in the second signal, said adaptive compensation filter being controlled by said detection unit; and a further adaptive compensation filter for reducing the acoustic feedback in the first signal, with said further adaptive compensation filter being controllable by said detection unit, and with the acoustic feedback in the second signal being reduced by said adaptive compensation filter which can be controlled by said further adaptive compensation filter.

11. The hearing device according to claim 10, further comprising a receiver, which forms an acoustic output signal from a feedback-reduced second signal.

* * * * *